US005893551A

United States Patent [19]

Cousins et al.

[11] Patent Number: 5,893,551

[45] Date of Patent: Apr. 13, 1999

[54] VISE WITH FULLY MACHINABLE JAWS

[76] Inventors: Joseph Russell Cousins, RD 3, Box 284, Kittaning, Pa. 16201; Jeffrey John Baur, 22 Windmere Dr., Valencia, Pa. 16059

[21] Appl. No.: 08/853,228

[22] Filed: May 16, 1997

[51] Int. Cl.[6] ..... B25B 1/20

[52] U.S. Cl. ..... 269/43; 269/136; 269/154; 269/906; 269/283; 269/286

[58] Field of Search ..... 269/279, 283, 269/136, 43, 154, 153, 152, 99, 280, 282, 286, 906, 900, 73

[56] References Cited

U.S. PATENT DOCUMENTS

| | | | |
|---|---|---|---|
| 1,887,829 | 11/1932 | Vogl . | |
| 2,564,138 | 8/1951 | Walker . | |
| 4,251,066 | 2/1981 | Bowling | 269/283 |
| 4,529,183 | 7/1985 | Krason et al. . | |
| 4,928,937 | 5/1990 | Bernstein . | |
| 4,934,674 | 6/1990 | Bernstein . | |
| 5,022,636 | 6/1991 | Swann . | |
| 5,098,073 | 3/1992 | Lenz | 269/43 |
| 5,163,662 | 11/1992 | Bernstein . | |
| 5,242,159 | 9/1993 | Bernstein . | |
| 5,351,943 | 10/1994 | Milz . | |
| 5,374,040 | 12/1994 | Lin . | |
| 5,458,321 | 10/1995 | Durfee, Jr. . | |
| 5,505,437 | 4/1996 | Durfee, Jr. . | |
| 5,716,043 | 2/1998 | Iwata et al. | 269/73 |

*Primary Examiner*—Robert C. Watson

*Attorney, Agent, or Firm*—David V. Radack; Eckert Seamans Cherin & Mellott, LLC

[57] ABSTRACT

A vise having machinable low profile removable jaws includes a stationary jaw attached between two movable jaws for holding two work pieces during a machining process. The stationary jaw is positioned adjacent to a pair of guide rails, which are mounted onto a base. The movable jaws are removably attached to a first and second slide member by a mating connection which is positioned below the work surface of the vise. The slide members are contained within a channel in the base. A screw shaft is disposed within a bore of the slide members and is contained within a tube and a sleeve which are telescopically connected together for protecting the threads of the screw shaft from metal chips and other debris. A tension mechanism is disposed in an aperture of the first and second slide members for controlling movement of the movable jaws. The base has interlocking edges for allowing vises positioned side by side to be mounted closer together.

20 Claims, 4 Drawing Sheets

VISE WITH FULLY MACHINABLE JAWS

BACKGROUND OF THE INVENTION

The invention relates to vises used during machining processes and, more particularly, to a vise having a fixed central jaw and two movable jaws for holding two work pieces during a precision machining process.

There are several types of vises used during machining, particularly with computer numerically controlled (CNC) equipment. One such device is disclosed in U.S. Pat. No. 4,529,183 to Krason et al. The vise includes two movable jaws and a centrally located fixed jaw for holding two work pieces. However, the mating connection of the jaw member and the slide member is positioned above the work surface of the vise and within the body of the movable jaw, reducing the area of the movable jaw which may be machined during the machining process.

Another vise is disclosed in U.S. Pat. No. 2,564,138 to Walker which includes a mating connection of a jaw and a slide member positioned around a screw shaft. However, the positioning of the mating connection around the screw shaft requires the male connector to have two extensions, weakening the strength of the male connector.

U.S. Pat. No. 5,351,943 to Milz discloses a vise having two fixed jaws and two movable jaws. However, the mating connection includes vertical and horizontal walls, as compared to angularly designed walls which substantially prevent vertical movement during clamping.

U.S. Pat. No. 5,458,321 to Durfee and U.S. Pat. No. 5,002,636 to Swann disclose means for biasing one slide member toward the central jaw. However, Swann uses a block member mounted adjacent to the slide member and Durfee uses an offset assembly attached to the slide, lengthening the overall design of the vise.

U.S. Pat. No. 5,163,662 to Bernstein discloses positioning two vises side-by-side. However, the edges of the vises do not interlock together, creating the possibility of movement of one vise with respect to the other.

U.S. Pat. No. 4,529,183 to Krason discloses the slide member having a collar portion. However, the collar portion does not cover the entire length of the screw shaft, exposing the threads of the screw shaft to machining chips and other debris.

Therefore, what is needed is an apparatus for holding work pieces which utilizes a low profile type of mating connection, a soft base and hard guide rails, a compact means for controlling sequential movement of the movable jaws, means for interlocking the bases of the vises, and means for protecting the screw shaft.

SUMMARY OF THE INVENTION

A vise adapted to hold two work pieces includes a base having a channel, and a pair of guide rails attached to the base and having a work surface. First and second slide members, which are positioned within the channel of the base, have a bore therethrough and a mating connection. A screw shaft is disposed through the bore of the first and second slide members and has a threaded portion.

First and second movable jaws have a machinable portion which extends above the work surface of the vise and a mating connection which extends below the work surface. The mating connections of the slide members and the movable jaws are engagable for removably attaching the movable jaws and the slide members together. The mating connection is positioned between the screw shaft and the work surface of the guide rails for enabling the machinable portion to be machined without damage to the first and second slide members. A stationary jaw is attached to the work surface of the pair of guide rails and is positioned between the first and second movable jaws. Hardened jaw plates may be attached to the movable or stationary jaws.

The screw shaft is enclosed with a tube, disposed and slidable within the bore of the first slide member, and a sleeve disposed within the bore of the second slide member and within a bore of the tube for telescopically attaching together the tube, the sleeve and the first slide member. The sleeve has a bore at least partially therethrough with an internally threaded portion for engagement with the threaded portion of the sleeve.

The vise may additionally include the base being constructed of a soft, lightweight material and the guide rails being constructed of a hardened steel. The base has a first interlocking edge and a second interlocking edge. Each of the first and second interlocking edges has a base plate edge and at least one protuberance. The protuberance of the first interlocking edge is positioned opposed to the base plate edge of the second interlocking edge and the base plate edge of the first interlocking edge is positioned opposed to the protuberance of the second interlocking edge so that an alignment of a plurality of vises enables a first interlocking edge of a first vise to mate with a second interlocking edge of a second vise.

Each of the mating connections of the first and second slide members has an aperture positioned perpendicular to the bore of the first and second slide members. A tension mechanism is disposed through each of the apertures of the first and second slide members and contacts the guide rails for controlling the movement of the movable jaws. The aperture of the second slide member is oval shaped causing the second slide member to move prior to movement of the first slide member during rotation of the screw shaft to open the vise. The tension mechanism of the second slide member exerts greater resistance between the guide rails as compared to the tension mechanism of the first slide member causing the first slide member to move toward the stationary jaw prior to the second slide member moving toward the stationary jaw, for controlling sequential movement of the movable jaws.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

The invention described herein provides an apparatus for holding two work pieces during a machining process.

Figure 1:
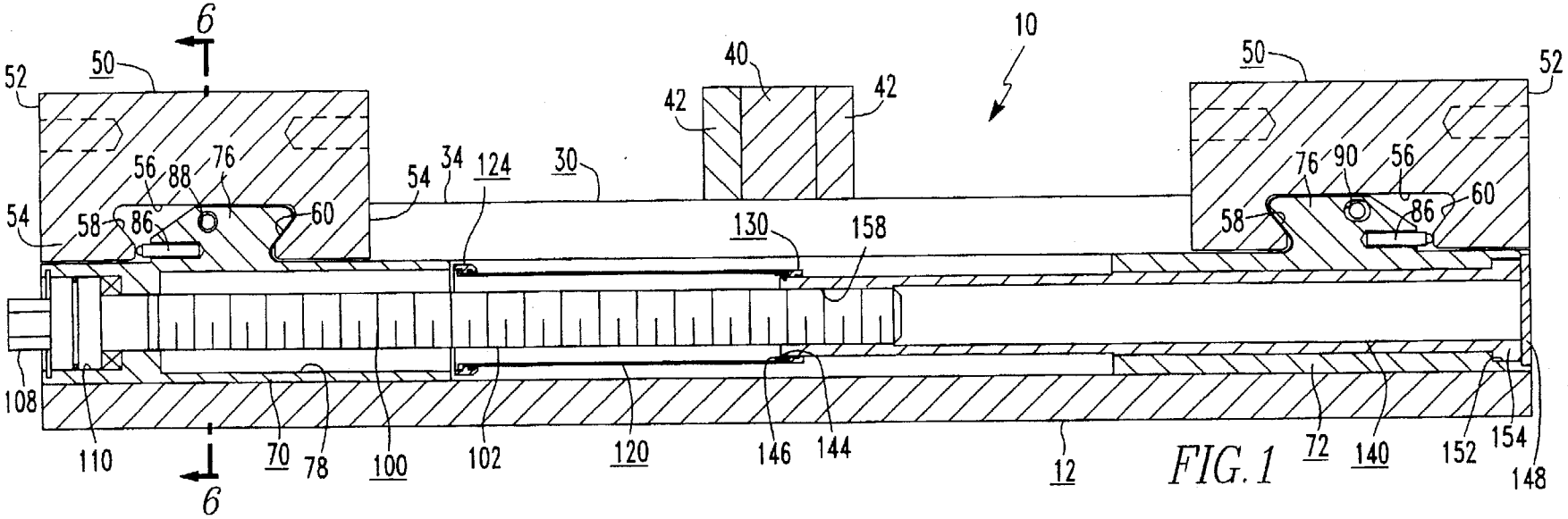
FIG. 1 is a partial sectional view of a vise.
Figure 2:
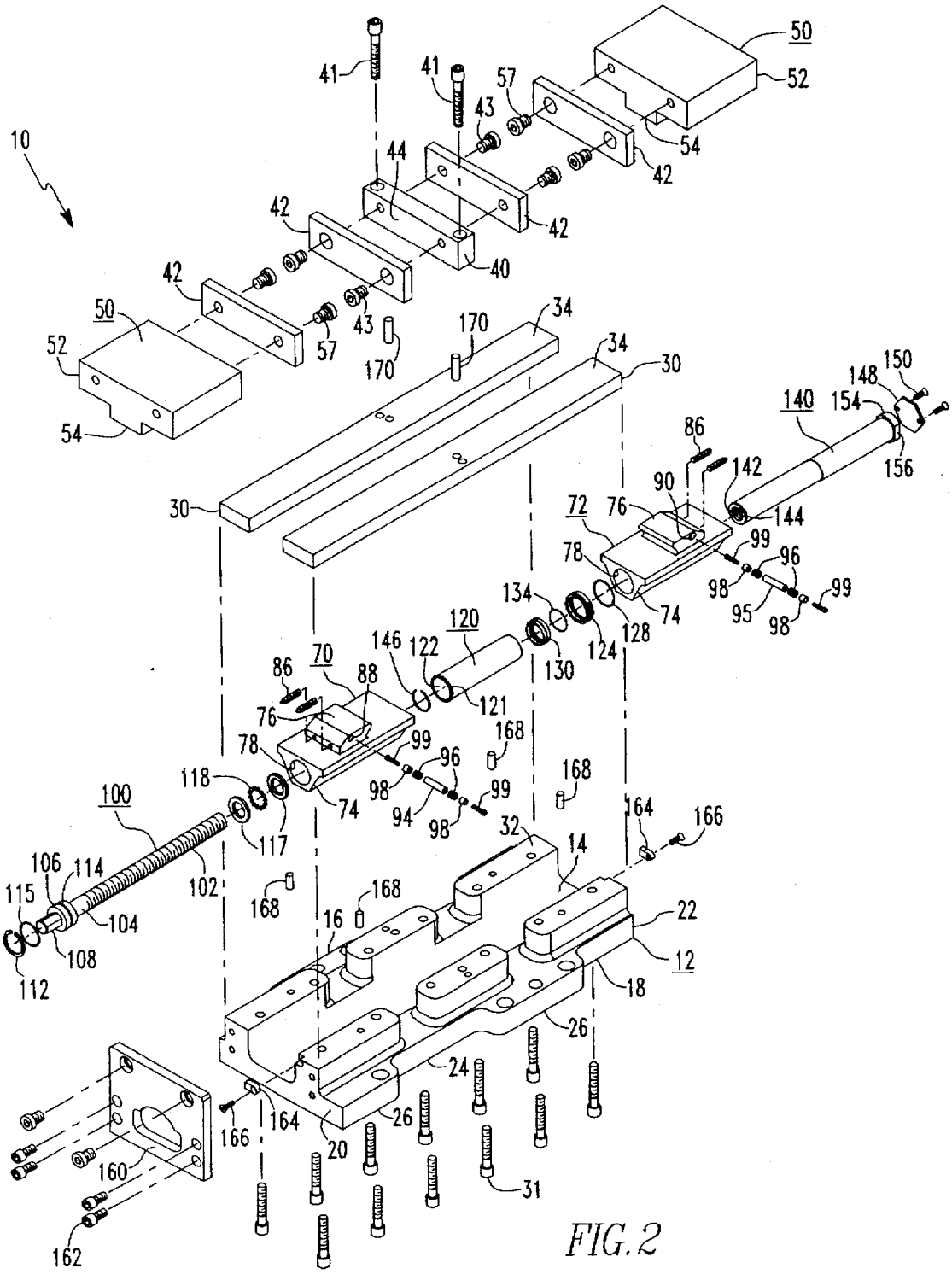
FIG. 2 is an exploded view of the vise.
Figure 3:
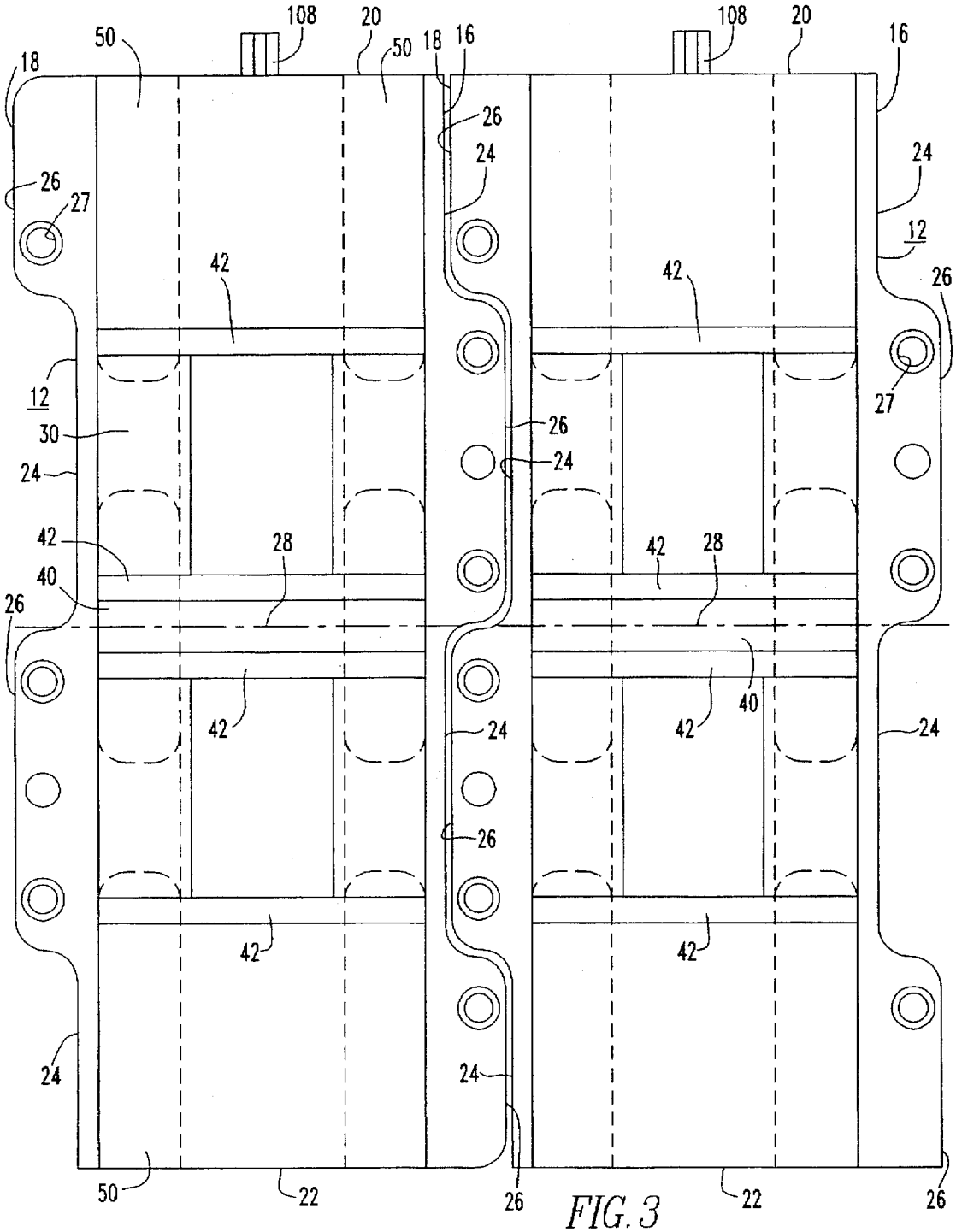
FIG. 3 is a top plan view of two vises positioned side by side.
Figure 4:
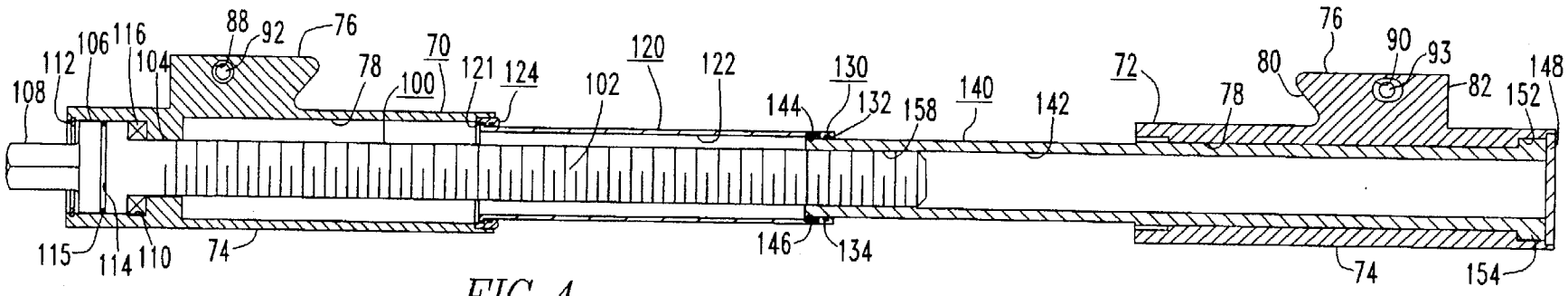
FIG. 4 is a partial sectional view of the vise showing a pair of slide members in an open position.
Figure 5A:
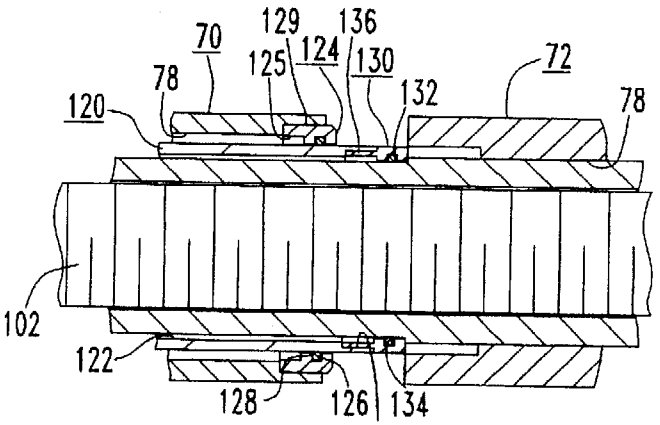
FIG. 5*a* is an enlarged partial view of FIG. 5 showing a retaining ring and a tube retaining end.
Figure 5:
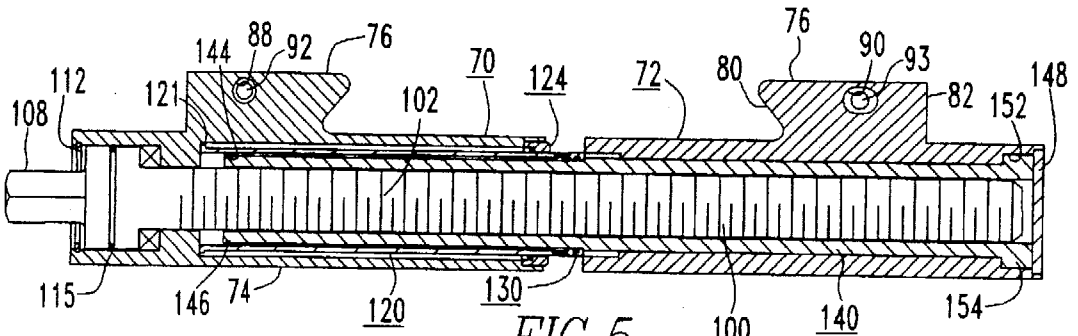
FIG. 5 is a partial sectional view of the vise showing the pair of slide members in a closed position.

Referring to FIGS. 1–3, a vise 10 has a base 12 with a channel 14, a first interlocking edge 16, a second interlocking edge 18 and opposite ends 20 and 22. Each of the interlocking edges 16 and 18 has a base plate edge 24 and at least one protuberance 26 extending therefrom. The protuberances 26 have bores 27 therethrough for securing the vise 10 to a support surface. By staggering the position of the protuberances 26 and disposing the protuberances 26 of one of the interlocking edges 16 and 18 opposite to the base plate edges 24 of the other of the interlocking edges 16 and 18, the interlocking edges 16 and 18 may be matingly engaged together when two or more vises 10 are positioned side-by-side.

The first interlocking edge 16 has one protuberance 26 positioned so that an edge of the protuberance 26 is substantially aligned with a center axis 28 of the base 12 and extends toward the end 20 of the base 12, and has another protuberance 26 positioned at the opposite end 22 of the base 12. A base plate edge 24 is positioned between the two protuberances 26 and at the end 20 of the base 12.

The second interlocking edge 18 has a protuberance 26 positioned with one edge substantially aligned with the center axis 28 of the base 12 and extending toward the end 22 of the base 12, and positioned opposite to the base plate edge 24 of the first interlocking edge 16. An additional protuberance 26 is positioned at the opposite end 20 of the base 12, and opposite to the other base plate edge 24 of the first interlocking edge 16. The base plate edge 24 of the second interlocking edge 18 is positioned between the two protuberances 26 and at the end 22 of the base 12.

A guide rail 30 is attached by a fastener, such as by bolts 31, screws, adhesively or other suitable means, to each of the surfaces 32 of the base 12 and extends above the channel 14 of the base 12. The guide rail 30 extends longitudinally and has a work surface 34 for contact with a work piece mounted thereon during the machining process. Preferably, the guide rails 30 are constructed of hardened steel for providing strength to the vise 10 and a durable working surface, particularly the work surface 34, and the base 12 is constructed of a lightweight material, such as a softer steel, plastic, a composite material, or the like, for reducing the overall weight of the vise 10.

A stationary jaw 40 is positioned at a central portion of the guide rails 30 and is removably or fixedly attached by a fastener, such as by bolts 41, screws, adhesively, or other suitable means, to the base 12 or to the guide rails 30 for providing a fixed jaw support for holding or referencing the position of a work piece. A jaw plate 42 may be attached by a fastener, such as by bolts 43, screws, adhesively or other suitable means, to each face 44 of the stationary jaw 40. The jaw plate 42 is formed of a hardened steel for providing strength during clamping.

A movable jaw 50 is positioned at each end of the base 12 having the stationary jaw 40 positioned therebetween. The movable jaws 50 are movable toward the stationary jaw 40 for clamping a work piece between each movable jaw 50 and the stationary jaw 40 for holding two work pieces during the machining process. The movable jaw 50 has a machinable portion 52 formed of a soft material, such as aluminum or other machinable material, and an extension 54 integrally formed therewith and having a mating connection 56.

The jaw plates 42 may be attached by a fastener, such as by bolts 57, screws, adhesively or other suitable means, to a face of the movable jaw 50. The jaw plates 42 are constructed of a hardened steel and used when it is not desirable to machine through the movable jaws 50.

The extension 54 of the movable jaw 50 extends between the guide rails 30 and the mating connection 56 of the extension 54 extends below the work surface 34 of the vise 10, providing a low profile type of mating connection. By positioning the mating connection 56 below the work surface 34, the entire machinable portion 52 can be machined without machining the mating connection 56. The mating connection 56 is a recess disposed within the extension 54. The recess has a first angular surface 58 and a second angular surface 60 for reversal of the machinable jaws 50 or hard jaw plates 42.

Being interchangable, one of the movable jaws 50 is removably attached to a first slide member 70 and another of the movable jaws 50 is removably attached to a second slide member 72. The first and second slide members 70 and 72 have a portion 74 sized and adapted to slide within the channel 14 of the base 12, and a mating connection 76 extending from and integrally formed with the portion 74. The portion 74 has a bore 78 extending therethrough.

The mating connection 76 of the first and second slide members 70 and 72 is sized and adapted to engage the mating connection 56 of the movable jaw 50 for securely attaching the movable jaw 50 to the slide member 70 or 72. The mating connection 76 is a protuberance having a first angular surface 80 and an edge 82, or alternatively, a second angular surface. Two holes 84 disposed partially through the mating connection 78 house ball plungers 86 for adjustably securing together the movable jaw 50 and the slide members 70 and 72.

Figure 6:
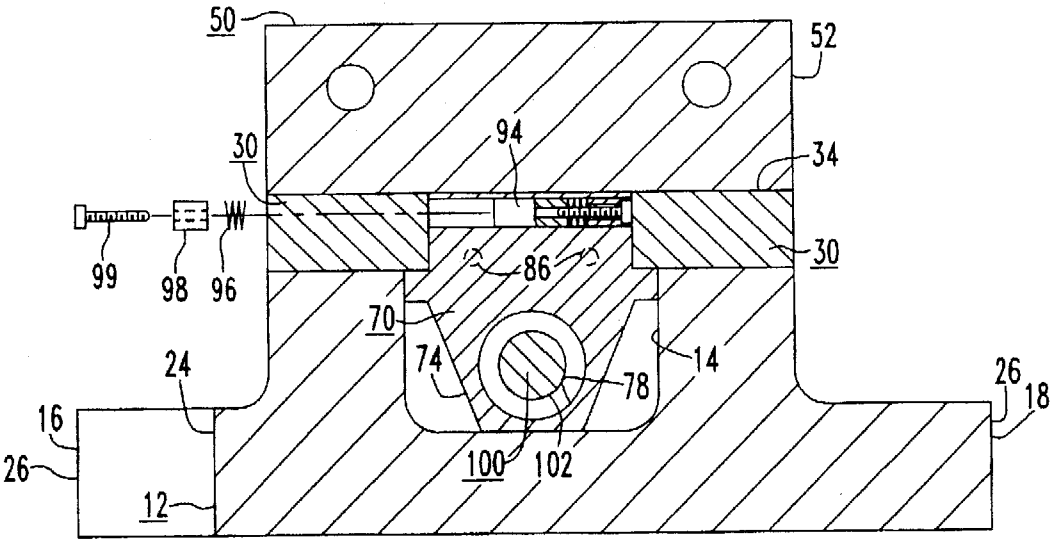
FIG. 6 is a partial sectional view taken along line 6—6 of FIG. 1.

Referring to FIGS. 1, 2 and 6, the first slide member 70 has an aperture 88 and the second slide member 72 has an aperture 90, which are positioned perpendicular to the bore 76 for housing a tension mechanism 92 and a tension mechanism 93, respectively. The tension mechanism 92 includes a pin 94 disposable within the aperture 88 of the first slide member 70, and the tension mechanism 93 includes a pin 95 disposable within the aperture 90 of the second slide member 72. Each of the tension mechanisms 92 and 93 includes a spring 96 positioned at each end of the pin 94 and 95, an end cap 98 positioned adjacent to each spring 96, and a fastener, such as a socket head cap screw 99, attached to each end cap 98 for securing together the components of the tension mechanism 92 and 93. The socket head cap screw 99 is disposed through the end cap 98, through the spring 96 and threaded into an internally threaded portion at each end of the pin 94 and 95. The tension mechanisms 92 and 93 exert force against the guide rails 30 for providing friction between the guide rails 30 and the first and second slide members 70 and 72.

The pin 95 disposed within the aperture 90 of the second slide member 72 is slightly longer than the pin 94 disposed within the aperture 88 of the first slide member 72. Use of a longer pin 95 within the second slide member 72 creates greater spring pressure and more resistance between the second slide member 72 and the guide rails 30 as compared to the resistance between the first slide member 70 and the guide rails 30, causing the first slide member 70 and movable jaw 50 to move toward the stationary jaw 40 prior to movement of the second slide member 70 and movable jaw 50 toward the stationary jaw 40.

The aperture 88 of the first slide member 70 is circular shaped providing a substantially snug fit of the tension mechanism 92 within the aperture 88. The aperture 90 of the second slide member 72 is oval shaped providing a loose fit of the tension mechanism 93 within the aperture 90. The oval shape of the aperture 90 enables the second slide member 72 to move a predetermined distance prior to movement of first slide member 70.

Referring to FIGS. 1–5*a*, a screw shaft 100 has a threaded portion 102 and a head portion 104. The head portion 104 has a collar 106 with a diameter larger than the diameter of the threaded portion 102. The head portion 104 also has means for rotation of the screw shaft 100, such as hexagonally shaped male portion 108. The collar 106 fits within a recess 110 of the first slide member 70 and is held within the recess 110 by a retaining clip 112, engagable with a groove in the recess 110. The collar 106 has a groove 114 for housing an O-ring 115. Positioned between the collar 106 and the first slide member 70 is a bearing 116 having a pair of races 117 and ball bearings 118 for facilitating movement of the screw shaft 100 against the first slide member 70.

A tube 120 having a flanged end 121 and a bore 122 is disposed within the bore 76 of the first slide member 70 and is slidable therein. A retainer ring 124 has a counterbore 125 at one end for engagement with the flanged end 121 of the tube 120. The retainer ring 124 has a groove 126 for seating an O-ring 128 at the other end of the tube 120. The retainer ring 124 has a threaded portion 129 for engagement with a threaded portion of the first slide member 70.

A tube retaining end 130 having a groove 132 for seating an O-ring 134 is positioned at an opposite end of the tube 120. The tube retaining end 130 has a protuberance 136 sized and adapted to be positioned within a counterbore 138 of the tube 120.

A sleeve 140, having a bore 142 at least partially therethrough, is disposed within the bore 78 of the second slide member 72 and within the bore 122 of the tube 120. The sleeve 140 has a groove 144 positioned at an open end for housing a retaining clip 146, such as a metal wire. A nut retainer plate 148 is attached by a fastener, such as by bolts 150, screws, adhesively, or other suitable means, to an opposite end of the second slide member 72 for retaining the sleeve 140.

The sleeve 140 has an end sized and adapted to correspond to a recess 152 positioned in the second slide member 72 for engagement of the sleeve 140 within the second slide member 72. Preferably, the closed end has a pair of flanges 154 diametrically opposed to one another and a flat edge 156 spaced therebetween, for preventing rotation of the sleeve 140 within the second slide member 72.

The tube 120 and the sleeve 140 telescopically move with respect to one another and within the first slide member 70. The screw shaft 100 is disposed within the tube 120 and sleeve 140 for providing a cover to protect the threaded portion 102 of the screw shaft 100 from metal chips and other debris during the machining process. The O-rings 128 and 134 prevent fluid flow between the tube 120 and the first slide member 70 and between the tube 120 and sleeve 140 for further protection of the screw shaft 100.

The bore 142 of the sleeve 140 has a threaded portion 158 having threads corresponding to threads of the threaded portion 102 of the screw shaft 100. Rotation of the screw shaft 100 moves the screw shaft 100 along the threads of the sleeve 140 for threaded engagement of the screw shaft 100 and the sleeve 140.

An end plate 160 may be attached to the base 12 by a fastener, such as by bolts 162, screws, adhesively, or other suitable means, for use of the vise 10 to hold one work piece between the two movable jaw 50, for clamping a single larger work piece. For this configuration of the vise 10, the stationary jaw 40 is removed.

A keeper 164 is attached to each end of the base 12 by a fastener, such as by bolts 166, screws, adhesively, or other suitable means, and contacts the first and second slide members 70 and 72 for limiting movement of the screw shaft 100.

The guide rails 30 and base 12 have corresponding holes for insertion of at least one dowel pin 168 for aligning the guide rails 30 with the base 12 during mounting of the guide rails 30 onto the base 12. The guide rails 30 and stationary jaw 40 have corresponding holes for insertion of at least one dowel pin 170 for aligning the stationary jaw 40 onto the guide rails 30.

Operation of the vise 10 includes positioning a work piece (not shown) between each of the movable jaws 50 and the stationary jaw 40. To close the jaws of the vise 10 and clamp the work pieces, the screw shaft 100 is rotated. The greater resistance provided by the tension mechanism 93 of the second slide member 72 causes the first slide member 70 to be pushed by the collar 106 of the screw shaft 100 and the movable jaw 50 to move toward the work piece.

After the movable jaw 50 attached to the first slide member 70 contacts the work piece, continual rotation of the screw shaft 100 causes the second slide member 72 to be pulled by the movement of the sleeve 140 along the threads of the screw shaft 100 and the movable jaw 50 to move toward the second work piece. After the movable jaw 50 attached to the second slide member 72 contacts the second work piece, continual rotation of the screw shaft 100 exerts clamping force onto the two work pieces for holding the work pieces during the machining process.

To open the vise 10, the screw shaft 100 is rotated in an opposite direction for removing the clamping force from the work pieces. The oval shape of the aperture 90 of the second slide member 72 causes the second slide member 72 to open the distance of travel within the aperture 90. After the second slide member 72 and movable jaw 50 moves the predetermined distance away from the work piece, the first slide member 70 moves away from the work piece until the first slide member 70 contacts the keeper 164. After contact of the first slide member 70 with the keeper 164, upon further rotation of the screw shaft 100, the second slide member 72 moves away from the work piece.

An advantage of the vise 10 is the low profile design of the mating connections 56 and 76 of the movable jaws 50 and the slide members 70 and 72. By positioning the mating connection 56 below the work surface 34 or bed of the vise 10, the entire portion of the movable jaw 50 above the work surface 34 may be machined without damage to the first and second slide members 70 and 72.

By forming the movable jaws 50 from a soft material, such as aluminum, the movable jaws 50 can be machined to accommodate various sizes and shapes of work pieces. The machinable jaws are interchangeable, removable, and disposable.

Another advantage of the vise is that the tension mechanisms 92 and 93 are integrally formed with the vise 10, providing a compact design. The tension mechanisms 92 and 93 restrict movement of the movable jaws 50 enabling the vise 10 to be positioned horizontally or vertically without slippage of the movable jaws 50. Additionally, the tension mechanism 93 controls the sequence of movement of the first and second slide members 70 and 72.

The interlocking feature of the base 12 enables more than one vise 10 to be positioned side-by-side and interlocked together. By matingly connecting the vises together, the possibility of movement of the vises with respect to one another is substantially reduced.

The enclosure of the screw shaft 100 within a cover, such as the tube 120 and the sleeve 140, is an advantage in that the threads of the screw shaft 100 are fully protected. Additionally, by threadedly connecting the screw shaft 100 to the sleeve 140, which is preferably formed of hardened steel, as compared to prior methods of threadedly connecting the screw shaft 100 to the slide member, which is formed of a soft metal, such as aluminum, the wear and life of the threads of the screw shaft 100 are increased.

Thus there has been shown and described a novel vise which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

We claim:

1. A vise adapted to hold two work pieces, comprising:

a base having a channel;

a pair of guide rails attached to said base and having a work surface;

a first slide member positioned within said channel of said base and having a bore therethrough and a mating connection;

a second slide member positioned within said channel of said base and having a bore therethrough and a mating connection;

a screw shaft disposed through said bore of said first and second slide members and having a threaded portion;

a first movable jaw having a machinable portion which extends above said work surface and a mating connection, said mating connection engagable with said mating connection of said first slide member for removably attaching said first movable jaw and said first slide member together, said mating connection positioned between said screw shaft and said work surface of said guide rails for enabling said machinable portion to be machined without damage to said first slide member;

a second movable jaw having a machinable portion which extends above said work surface and a mating connection, said mating connection engagable with said mating connection of said second slide member for removably attaching said second movable jaw and said second slide member together, said mating connection positioned between said screw shaft and said work surface of said guide rails for enabling said machinable portion to be machined without damage to said second slide member; and a stationary jaw positioned adjacent to said work surface of said pair of guide rails and between said first and second movable jaws.

2. The vise according to claim 1, wherein, said base is formed of a soft, lightweight material; and said guide rails are formed of a hardened steel.

3. The vise according to claim 1, further comprising:

a tube, disposed and slidable within said bore of said first slide member, having a bore therethrough;

a sleeve disposed within said bore of said second slide member and within said bore of said tube for telescopically attaching together said tube, said sleeve and said first slide member, said sleeve having a bore at least partially therethrough with an internally threaded portion; and said screw shaft disposed within said tube and within said sleeve, said threaded portion of said screw shaft engagable with said threaded portion of said sleeve.

4. The vise according to claim 1, wherein said base has a first interlocking edge and a second interlocking edge, said first interlocking edge having a first base plate edge and at least one protuberance, said second interlocking edge having a second base plate edge and at least one protuberance, said protuberance of said first interlocking edge positioned opposed to said second base plate edge of said second interlocking edge, and said first base plate edge of said first interlocking edge positioned opposed to said protuberance of said second interlocking edge so that an alignment of a plurality of vises enables a first interlocking edge of a first vise to mate with a second interlocking edge of a second vise.

5. The vise according to claim 1, further comprising:

each of said mating connections of said first and second slide members having an aperture positioned perpendicular to said bore of said first and second slide members; and a tension mechanism disposed through each of said apertures of said first and second slide members and contacting said guide rails for controlling movement of said movable jaws.

6. The vise according to claim 5, wherein said aperture of said second slide member is oval shaped causing said second slide member to move prior to movement of said first slide member during rotation of said screw shaft.

7. The vise according to claim 5, wherein said tension mechanism of said second slide member exerts greater resistance between said guide rails as compared to said tension mechanism of said first slide member causing said first slide member to move toward said stationary jaw prior to said second slide member moving toward said stationary jaw during closing of said vise for controlling sequential movement of said movable jaws.

8. A vise adapted to hold two work pieces, comprising:

a base having a channel;

a pair of guide rails mounted onto said base and having a work surface;

a central stationary jaw positioned adjacent to said work surface of said pair of guide rails;

a first slide member positioned within said channel of said base and having a bore therethrough and a mating connection, said first slide member movable within said channel toward and away from said stationary jaw;

a second slide member positioned within said channel of said base and having a bore therethrough and a mating connection, said second slide member movable within said channel toward and away from said stationary jaw;

a tube, disposed and slidable within said bore of said first slide member, having a bore therethrough;

a sleeve disposed within said bore of said second slide member and within said bore of said tube for telescopically attaching together said tube, said sleeve and said first slide member, said sleeve having a bore at least partially therethrough with an internally threaded portion;

a screw shaft disposed within said tube and within said sleeve and having a threaded portion engagable with said threaded portion of said sleeve;

a first movable jaw having a machinable portion which extends above said work surface and a mating connection, said mating connection engagable with said mating connection of said first slide member for removably attaching said first movable jaw and said first slide member together, said mating connection positioned between said screw shaft and said work surface of said guide rails for enabling said machinable portion to be machined without damage to said first slide member; and a second movable jaw having a machinable portion which extends above said work surface and a mating connection, said mating connection engagable with said mating connection of said second slide member for removably attaching said second movable jaw and said second slide member together, said mating connection positioned between said screw shaft and said work surface of said guide rails for enabling said machinable portion to be machined without damage to said second slide member.

9. The vise according to claim 8, further comprising:

said sleeve having at least one flange and at least one flat edge; and said second slide member having a recess sized and adapted for receiving said flat edge and said flange of said sleeve for preventing rotation of said sleeve and for slidable movement of said second slide member when said screw shaft is rotated.

10. The vise according to claim 8, wherein said guide rails have a hardened work surface.

11. The vise according to claim 8, further comprising:

said mating connection of said first slide member has an aperture positioned perpendicular to said bore of said first slide member;

said mating connection of said second slide member has an oval shaped aperture positioned perpendicular to said bore of said second slide member; and a tension mechanism disposed through each of said apertures of said first and second slide members and contacting said guide rails for restricting movement of said movable jaws.

12. The vise according to claim 8, wherein said first and second slide members are constructed of aluminum and said tube and said sleeve are constructed of high strength steel.

13. A vise adapted to hold two work pieces, comprising:

a base having a channel, a first interlocking edge and a second interlocking edge, said first interlocking edge having a first base plate edge and at least one protuberance, said second interlocking edge having a second base plate edge and at least one protuberance, said protuberance of said first interlocking edge positioned opposed to said second base plate edge of said second interlocking edge and said first base plate edge of said first interlocking edge positioned opposed to said protuberance of said second interlocking edge so that an alignment of a plurality of vises enables a first interlocking edge of a first vise to mate with a second interlocking edge of a second vise;

a pair of guide rails mounted onto said base and having a work surface;

a central stationary jaw positioned adjacent to said work surface of said pair of guide rails;

a first slide member positioned within said channel of said base and having a bore therethrough and having a mating connection, said first slide member movable within said channel toward and away from said stationary jaw;

a second slide member positioned within said channel of said base and having a bore therethrough and having a mating connection, said second slide member movable within said channel toward and away from said stationary jaw;

a screw shaft disposed through said bore of said first and second slide members and having a threaded portion for controlling movement of said first and second slide members;

a first movable jaw having a machinable portion which extends above said work surface and a mating connection, said mating connection engagable with said mating connection of said first slide member for removably attaching said first movable jaw and said first slide member together, said mating connection positioned between said screw shaft and said work surface of said guide rails for enabling said machinable portion to be machined without damage to said first slide member; and a second movable jaw having a machinable portion which extends above said work surface and a mating connection, said mating connection engagable with said mating connection of said second slide member for removably attaching said second movable jaw and said second slide member together, said mating connection positioned between said screw shaft and said work surface of said guide rails for enabling said machinable portion to be machined without damage to said second slide member.

14. The vise according to claim 13, wherein said base has a first end and a second end and each of said first and second interlocking edges has a first protuberance positioned with an edge substantially aligned with a center axis of said base and extending toward one of said ends of said base and a second protuberance positioned at the other end of said base.

15. The vise according to claim 13, further comprising:

a tube, disposed and slidable within said bore of said first slide member, having a bore therethrough;

a sleeve disposed within said bore of said second slide member and within said bore of said tube for telescopically attaching together said tube, said sleeve and said first slide member, said sleeve having a bore at least partially therethrough with an internally threaded portion; and said screw shaft disposed within said tube and within said sleeve, said threaded portion of said screw shaft engagable with said threaded portion of said sleeve.

16. The vise according to claim 13, further comprising:

each of said mating connections of said first and second slide members has an aperture positioned perpendicular to said bore of said first and second slide members; and a tension mechanism disposed through each of said apertures of said first and second slide members and contacting said guide rails for restricting movement of said movable jaws.

17. A vise adapted to hold two work pieces, comprising:

a base having a channel;

a pair of guide rails mounted onto said base and having a work surface;

a central stationary jaw positioned adjacent to said work surface of said pair of guide rails;

a first slide member positioned within said channel of said base and having a bore therethrough and a mating connection, said first slide member movable within said channel toward and away from said stationary jaw, said mating connection having an aperture disposed perpendicular to said bore;

a second slide member positioned within said channel of said base and having a bore therethrough and a mating connection, said second slide member movable within said channel toward and away from said stationary jaw, said mating connection having an oval shaped aperture disposed perpendicular to said bore a screw shaft disposed through said bore of said first and second slide members and having a threaded portion for controlling movement of said first and second slide members;

a first tension mechanism disposed through said aperture of said first slide member and contacting said guide rails for providing resistance between said first slide member and said guide rails;

a second tension mechanism disposed through said aperture of said second slide member and contacting said guide rails for providing resistance between said second slide member and said guide rails, said second tension mechanism exerting greater resistance between said second slide member and said guide rails as compared to the resistance between said first slide member and said guide rail for controlling the sequential movement of the first and second slide members during closing of said movable jaws, said oval shaped aperture causing said second slide member to move away from said stationary jaw the distance of travel within said oval shaped aperture prior to movement of said first slide member during opening of said movable jaws;

a first movable jaw having a machinable portion which extends above said work surface and a mating connection, said mating connection engagable with said mating connection of said first slide member for removably attaching said first movable jaw and said first slide member together, said mating connection positioned between said screw shaft and said work surface of said guide rails for enabling said machinable portion to be machined without damage to said first slide member; and a second movable jaw having a machinable portion which extends above said work surface and a mating connection, said mating connection engagable with said mating connection of said second slide member for removably attaching said second movable jaw and said second slide member together, said mating connection positioned between said screw shaft and said work surface of said guide rails for enabling said machinable portion to be machined without damage to said second slide member.

18. The vise according to claim 17, wherein said first and second tension mechanism includes, a pin having an elongated shape with an internally threaded portion at each end, said pin of said second tension mechanism being longer than said pin of said first tension mechanism for enabling said second tension mechanism to exert greater resistance between said guide rails and said second slide member as compared to the resistance exerted between said guide rails and said first slide member for controlling the sequential movement of said movable jaws;

a spring positioned at each of said ends of said pin;

an end cap positioned adjacent to each spring; and a fastener disposed through said end caps, through said springs and threadedly attached to each of said pins.

19. The vise according to claim 17, further comprising:

a tube, disposed and slidable within said bore of said first slide member, having a bore therethrough;

a sleeve disposed within said bore of said second slide member and within said tube for telescopically attaching together said tube, said sleeve and said first slide member, said sleeve having a bore at least partially therethrough with an internally threaded portion; and said screw shaft disposed within said tube and within said sleeve, said threaded portion of said screw shaft engagable with said threaded portion of said sleeve.

20. The vise according to claim 17, wherein said base has a first interlocking edge and a second interlocking edge, said first interlocking edge having a first base plate edge and at least one protuberance, said second interlocking edge having a second base plate edge and at least one protuberance, said protuberance of said first interlocking edge positioned opposed to said second base plate edge of said second interlocking edge and said first base plate edge of said first interlocking edge positioned opposed to said protuberance of said second interlocking edge so that an alignment of a plurality of vises enables a first interlocking edge of a first vise to mate with a second interlocking edge of a second vise.

* * * * *